US008544389B2

(12) United States Patent
Kono et al.

(10) Patent No.: US 8,544,389 B2
(45) Date of Patent: Oct. 1, 2013

(54) GUIDE RAIL

(75) Inventors: Hiroyuki Kono, Tokyo (JP); Yoichi Kameda, Tokyo (JP); Kuniaki Oka, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/003,483

(22) PCT Filed: Mar. 30, 2010

(86) PCT No.: PCT/JP2010/002328

§ 371 (c)(1),
(2), (4) Date: Feb. 17, 2011

(87) PCT Pub. No.: WO2011/074146

PCT Pub. Date: Jun. 23, 2011

(65) Prior Publication Data

US 2012/0168525 A1 Jul. 5, 2012

(30) Foreign Application Priority Data

Dec. 15, 2009 (JP) ..... P2009-284460

(51) Int. Cl.
*E01B 25/28* (2006.01)
*E01B 19/00* (2006.01)

(52) U.S. Cl.
USPC ..... 104/130.07; 238/382

(58) Field of Classification Search
USPC ..... 104/130.07; 238/262, 243, 246, 238/382
See application file for complete search history.

(56) References Cited

U.S. PATENT DOCUMENTS

| | | | | |
|---|---|---|---|---|
| 483,993 | A * | 10/1892 | Curtis | 238/125 |
| 925,552 | A * | 6/1909 | Alden | 238/243 |
| 3,952,948 | A * | 4/1976 | Nelson et al. | 238/243 |
| 6,402,044 | B1 * | 6/2002 | Sato | 238/382 |

FOREIGN PATENT DOCUMENTS

| | | |
|---|---|---|
| JP | S52-31103 | 3/1977 |
| JP | S53-080606 | 7/1978 |
| JP | S55-023281 | 2/1980 |
| JP | S59-192101 | 10/1984 |
| JP | S64-004884 | 2/1989 |
| JP | H05-093403 | 4/1993 |
| JP | H05-202501 | 8/1993 |

(Continued)

OTHER PUBLICATIONS

The Japan Society of Mechanical Engineers Ed., JSME Mechanical Engineers' Handbook, Applications, γ6: Vehicle and Transport Systems, May 15, 2006, pp. 158-162 With Partial English Translation.

(Continued)

*Primary Examiner* — Mark Le
(74) *Attorney, Agent, or Firm* — Manabu Kanesaka; Kenneth M. Berner; Benjamin J. Hauptman

(57) ABSTRACT

A guide rail that is provided in a track and is brought into contact with a guide wheel of a vehicle to restrict a rolling direction of a running wheel of the vehicle, to thereby guide the vehicle along the track, includes: a rail that comprises a guide portion formed with a guide rail surface with which the guide wheel is brought into contact; and a vibration-isolating member that is provided so as to be in contact with a back surface of the guide rail surface of the guide portion.

12 Claims, 11 Drawing Sheets

(56) References Cited

FOREIGN PATENT DOCUMENTS

| | | | |
|---|---|---|---|
| JP | H06-088302 | | 3/1994 |
| JP | H06-101201 | | 4/1994 |
| JP | 2001-342602 | | 12/2001 |
| JP | 2005-522602 | | 7/2005 |
| JP | 2006-002443 | | 1/2006 |
| JP | 2006002443 | * | 1/2006 |

OTHER PUBLICATIONS

Hiroshi Kubota, Railroad Engineering Handbook, Grand Prix Book Publishing, Sep. 19, 1995, pp. 329-337 With Partial English Translation.

Crystal Mover, Mitsubishi New Transit System for the 21st Century, Mitsubishi Heavy Industries, Ltd.

* cited by examiner

GUIDE RAIL

RELATED APPLICATIONS

The present application is National Phase of International Application No. PCT/JP2010/002328 filed Mar. 30, 2010, and claims priority from, Japanese Application No. 2009-284460, filed Dec. 15, 2009, the disclosure of which is hereby incorporated by reference herein in its entirety.

TECHNICAL FIELD

The present invention relates to a guide rail that is provided in a track and restricts the direction of rolling of a running wheel of a vehicle by contacting with a guide wheel of the vehicle, to thereby guide the vehicle along the track.

Priority is claimed on Japanese Patent Application No. 2009-284460, filed on Dec. 15, 2009, the contents of which are incorporated herein by reference.

BACKGROUND ART

In recent years, as new traffic systems except for buses and railways, new transit systems have attracted attention. As one type of the new transit systems, a system is known in which a vehicle having rubber wheels as running wheels automatically travels on a track (Automated People Mover, Automated Transit Systems).

This type of new transit system is roughly made of: a vehicle having a vehicle body, rubber tires, electric motors, and guide wheels; running surfaces along which the rubber tires roll; a contact line that supplies electric power to the electric motors; and guide rails. The new transit system supplies electric power from the contact line to the electric motors and rotates the rubber tires through drive of the electric motors, to thereby travel the vehicle along the track.

In this type of new transit system, the vehicle itself does not typically include a mechanism of actively controlling the direction of rolling of the rubber tires, but includes only two guide wheels that are attached to both sides of the lower portion of the vehicle in the width direction so as to protrude in the substantially horizontal direction. Two guide rails, which are attached to both sides of the track in the width direction along the running direction of the track so as to face the guide wheels, are brought into contact with the corresponding guide wheels, to thereby restrict the rolling direction of the rubber tires, allowing the vehicle to travel along the track (for example, see Non-Patent Document 1 and Non-Patent Document 2).

CITATION LIST

Non-Patent Document

Non-Patent Document 1: The Japan Society of Mechanical Engineers ed., JSME Mechanical Engineers' Handbook, Applications, γ6: Vehicle and Transport Systems, May 15, 2006, pp. 158-162

Non-Patent Document 2: Hiroshi Kubota, Railroad Engineering Handbook, Grand Prix BOOK PUBLISHING, Sep. 19, 1995, pp. 329-337

SUMMARY OF THE INVENTION

Problems to be Solved by the Invention

In the above new transit system, there are cases where, when the guide wheel is brought into collision contact or rolling contact with the guide rail, vibration is generated, and noise due to the vibration is made inside and outside the vehicle.

The present invention has been achieved in view of such circumstances, and its object is to provide a guide rail capable of suppressing noise in a new transit system.

Means for Solving the Problems

To achieve the above object, a guide rail according to the present invention is a guide rail that is provided in a track and is brought into contact with a guide wheel of a vehicle to restrict a rolling direction of a running wheel of the vehicle, to thereby guide the vehicle along the track, including: a rail that comprises a guide portion formed with a guide rail surface with which the guide wheel is brought into contact; and vibration-isolating member that is provided so as to be in contact with a back surface of the guide rail surface of the guide portion.

According to this structure, the vibration-isolating member is provided on the back surface of the guide rail surface of the guide portion. Therefore, it is possible to suppress noise. To be more specific, when the guide wheel is brought into collision contact or rolling contact with the guide rail surface, the vibration generated by the contact is transmitted from the back surface of the guide rail surface to the vibration-isolating member. Then, the energy of the vibration having been transmitted to the vibration-isolating member is consumed by frictional heat of the molecules in the vibration-isolating member. Thereby, the vibration is reduced. Thus, because the vibration-isolating member is provided on the back surface of the guide rail surface of the guide portion in which the vibration is generated, it is possible to effectively transmit the vibration generated in guide rail surface to the vibration-isolating member on the back surface to reduce the vibration. Therefore, it is possible to effectively suppress the noise that is made by the vibration from contact between the guide wheel and the guide rail surface being propagated from the rail through the air.

The rail may further include a support portion that supports the guide portion by the back surface of the guide portion, and the vibration-isolating member may be provided so as to be in contact with the side surface of support portion.

In this case, the vibration-isolating member is in contact also with the side surface of the support portion. Therefore, the vibration from contact between the switch wheel and the guide rail surface is transmitted to the vibration-isolating member not only from the back surface of the guide portion but also from the side surface of the support portion. This makes it possible to decrease the vibration, in the vibration-isolating member, transmitted from the side surface of support portion. Therefore, it is possible to further suppress noise.

A fixation unit may be included that fixes the vibration-isolating member by pressing against the rail.

In this case, the fixation unit fixes the vibration-isolating member by pressing against the rail is provided. Therefore, it is possible to more effectively bring the vibration-isolating member into close contact with the rail. This makes it possible to more effectively transmit the vibration from the rail to the vibration-isolating member. Furthermore, it is possible to securely fix the vibration-isolating member to the rail, to thereby continuously obtain an effect of noise suppression.

The fixation unit may fix the vibration-isolating member by pressing against the back surface of the rail along a normal of the back surface.

In this case, the fixation unit fixes the vibration-isolating member by pressing against the rail along the normal of the back surface. Therefore, it is possible to more effectively bring the vibration-isolating member into close contact with the rail. This makes it possible to effectively transmit the vibration from the rail to the vibration-isolating member. Furthermore, it is possible to securely fix the vibration-isolating member to the back surface of the rail, to thereby continuously obtain an effect of noise suppression.

There may be included a plate that is provided so as to sandwich the vibration-isolating member between the guide portion of the rail and the plate, and the fixation unit may press the plate against the vibration-isolating member, to thereby fix the vibration-isolating member to the rail.

In this case, the fixation unit presses the plate against the vibration-isolating member, to thereby fix the vibration-isolating member. Therefore, it is possible to disperse the pressing force from the fixation unit over all the plate surface of the plate, to thereby fix the vibration-isolating member to the rail with a uniform force. Therefore, without making vibration that is transmitted from the rail to the vibration-isolating member non-uniform, it is possible to uniformly reduce the vibration in the respective parts of the vibration-isolating member.

An adhesion layer made from an adhesive material may be formed between the vibration-isolating member and the rail.

In this case, the adhesion layer made from an adhesive material is formed between the vibration-isolating member and the rail. Therefore, it is possible to more effectively bring the vibration-isolating member into close contact with the rail. This makes it possible to more effectively transmit the vibration from the rail to the vibration-isolating member. Furthermore, it is possible to securely fix the vibration-isolating member to the rail, to thereby continuously obtain an effect of noise suppression.

It is preferable that the plate be provided so as not to contact with the rail.

In this case, the plate is provided so as not to contact with the rail. This suppresses vibration from being transmitted directly to the plate. As a result, it is possible to suppress vibration from being propagated from the plate through the air, to thereby make noise.

The vibration-isolating member may be provided so as to run along a longitudinal direction of the rail, and a plurality of the fixation units may be disposed in a staggered arrangement so as to be displaced in a direction orthogonal to the longitudinal direction.

In this case, the vibration-isolating member runs in the longitudinal direction of the rail main unit, and a plurality of fixation units are provided in a staggered arrangement in the longitudinal direction so as to be displaced in the direction orthogonal to the longitudinal direction. As a result, it is possible to fix the vibration-isolating member to the rail with a uniform force. Therefore, it is possible to transmit the vibration from the rail uniformly over the whole of the vibration-isolating member, to thereby reduce the vibration.

According to the guide rails of the present invention, it is possible to suppress noise in a new transit system.

BEST MODE FOR CARRYING OUT THE INVENTION

Hereunder is a description of an embodiment of the present invention, with reference to the drawings.

(Schematic Structure of New Transit System)

A schematic structure of a new transit system (hereinafter, referred to as "APM") will be described. The APM is a vehicle with rubber tires that is incorporated into a traffic system having a track. The vehicle automatically travels along a track. In the following description, "forward and rearward in the traveling direction of the vehicle" are referred simply as "forward and rearward."

Figure 1:
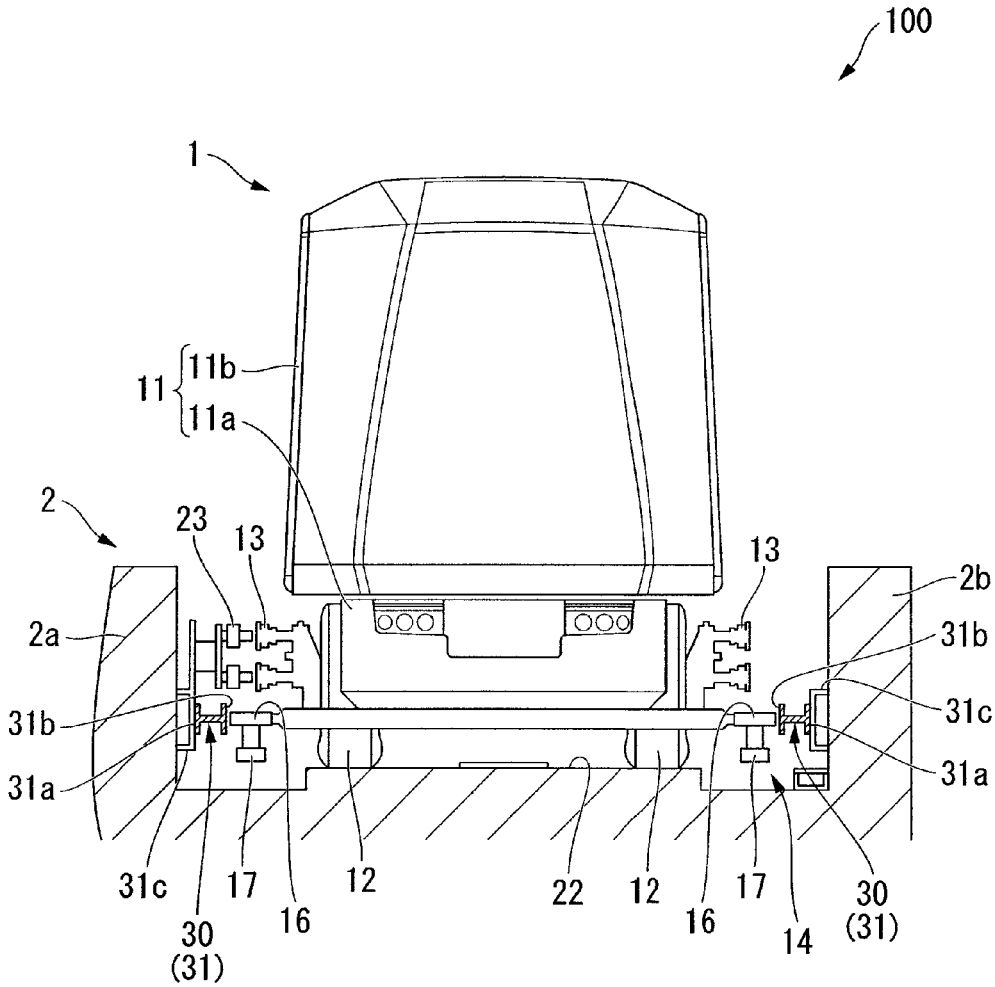
FIG. 1 is a front view showing a schematic structure of a new transit system (APM) according to an embodiment of the present invention.
Figure 2:
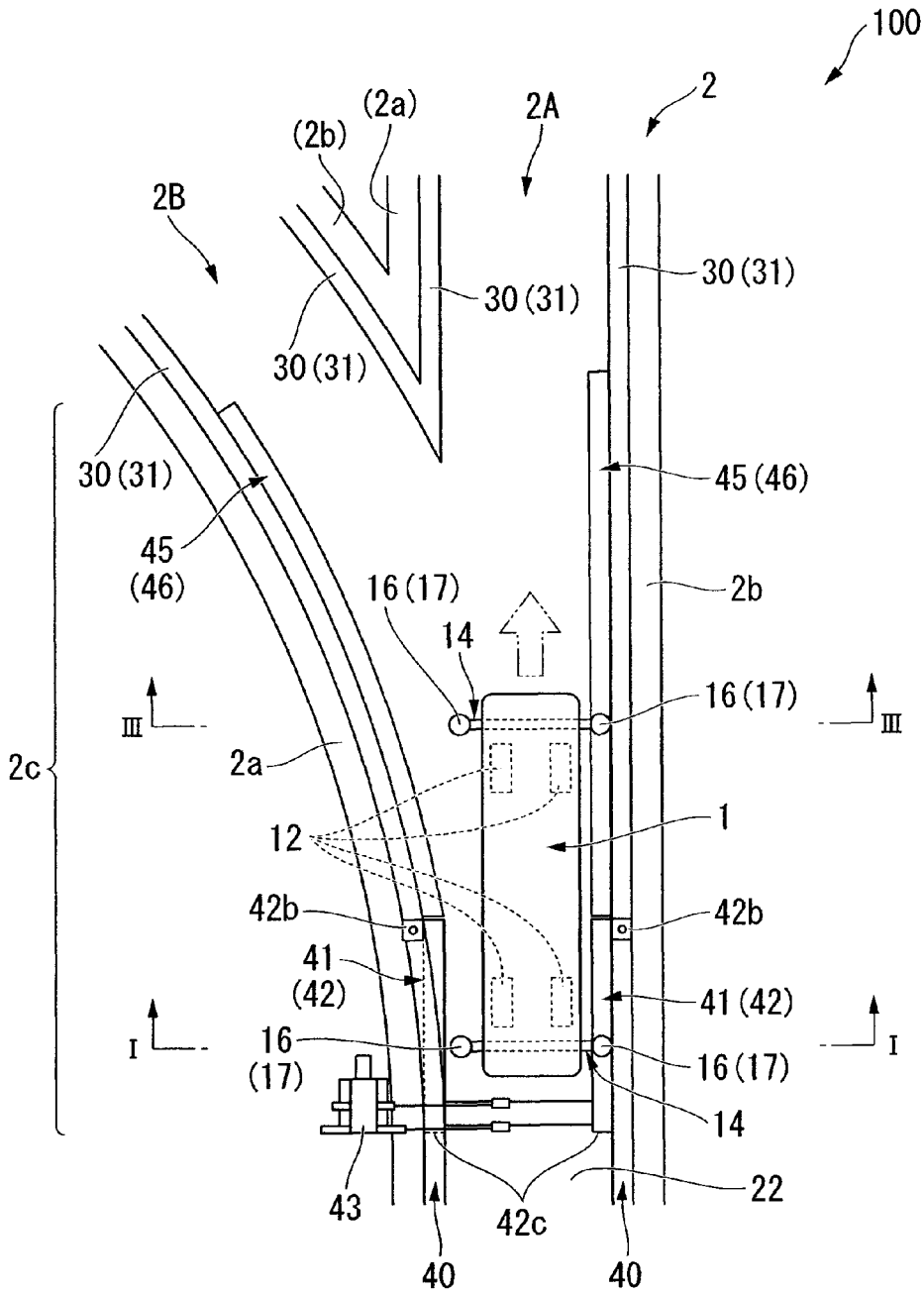
FIG. 2 is a plan view showing the schematic structure of the new transit system (APM) according to the embodiment of the present invention.

FIG. 1 is a front view showing a schematic structure of an APM 100 according to an embodiment of the present invention. FIG. 2 is a plan view showing the schematic structure of the APM 100.

As shown in FIG. 1, a vehicle 1 includes: a vehicle body 11; running wheels 12 made of rubber tires; electric motors (not shown in the figure) for rotating the running wheels 12; and guide wheel units 14 that restrict a rolling direction of the running wheels 12.

The vehicle body 11 includes: an undercarriage 11*a*; and a rectangular-cuboid-like vehicle body main unit 11*b* provided on the undercarriage 11*a*.

As shown in FIG. 2, two running wheels 12 are provided on both the forward and rearward portions of the undercarriage 11*a*. Each running wheel 12 is capable of changing the rolling direction.

Note that the vehicle 1 itself is not provided with a mechanism for actively controlling the rolling direction of the running wheels 12.

As shown in FIG. 1, electric power is supplied to the electric motors (not shown in the figure) via power collection apparatuses 13 arranged on both sides of the undercarriage 11*a* in the width direction.

As shown in FIG. 2, two guide wheel units 14 are respectively fixed to the forward portion and the rearward portion of the undercarriage 11*a*. As shown in FIG. 1, each guide wheel unit 14 is located, in the vertical direction, below the power collection apparatus 13 and above the contact portion of the running wheel 12 with the road surface, and is provided with a plurality of guide wheels whose axes of rotation are in the substantially vertical direction.

Each of the guide wheels includes two types of wheels: a guide wheel 16 and a switch wheel 17.

In each guide wheel unit 14, the guide wheels 16 are disposed on both sides of the vehicle body 11 in the width direction, one on each side. The guide wheels 16 rotate freely when an external force acts tangentially thereon.

In each guide wheel unit 14, the switch wheels 17 are disposed on both sides of the vehicle body 11 in the width direction, one on each side. The switch wheels 17 are located below their corresponding guide wheels 16, and rotate freely when an external force acts tangentially thereon.

The track 2 includes: a running surface 22 on which the running wheels 12 roll, and a contact line 23 that supplies electric power to the power collection apparatuses 13, as shown in FIG. 1; and travel guide rails 30 and switch guide rails 40 that restrict the direction of rolling of the running wheels 12, as shown in FIG. 2.

The running surface 22 is formed from concrete or the like, and runs in the direction in which the track 2 runs as shown in FIG. 2.

As shown in FIG. 1, the contact line 23 is provided on a side wall portion 2*a* of side wall portions 2*a*, 2*b* on both sides of the track 2 in the width direction, and supplies electric power to the power collection apparatuses 13.

Each travel guide rail 30 includes a plurality of H-shaped rails 31 made of H-shaped steel.

The H-shaped rails 31 are fixed to the side wall portions 2*a*, 2*b* so that their longitudinal direction is along the direction in which the track 2 runs. In each of the side wall portions 2*a*, 2*b*, the H-shaped rails 31 are continuously disposed along the running surface 22. Furthermore, each H-shaped rail 31 is positioned at a height substantially the same as that of the guide wheels 16 in a state with the running surface 22 supporting the vehicle 1 (in a state with the running wheels 12 in contact with the running surface 22).

As shown in FIG. 1, the H-shaped rail 31 has two flanges. An outside surface of one of them (fixed portion) is a fixed surface 31*a* that faces the side wall portion (2*a* or 2*b*). An outside surface of the other (guide portion) is a guide rail surface 31*b* that is brought into contact with the guide wheel 16. The H-shaped rail 31 is fixed to the side wall portion (2*a* or 2*b*) via a plurality of fixation units 31*c* (shown in FIG. 1, and not shown in FIG. 3 (described later)) that are disposed between the fixed surface 31*a* and the side wall portion (2*a* or 2*b*) so as to keep a space in the longitudinal direction.

In each pair of H-shaped rails 31 fixed to the side wall portions 2*a*, 2*b*, the distance between the outer circumferential surfaces of the two opposing guide rail surfaces 31*b* is slightly larger than a maximum width between the two guide wheels 16 in each guide wheel unit 14.

With such a structure, the travel guide rail 30 allows at least one of the guide wheels 16 of the guide wheel units 14 to roll in the track 2, restricts the direction of rolling of the running wheels 12, and allows the vehicle 1 to travel along the track 2.

As shown in FIG. 2, the switch guide rails 40 are disposed in a branch portion 2C of the track 2 in which a branch track 2B is branched from a main track 2A. The switch guide rails 40 are disposed below the travel guide rails 30. Each switch guide rail 40 is separated into a movable guide portion 41 located on the near the traveling direction of the vehicle 1 and a fixed guide portion 45 located on the far side.

Figure 3:
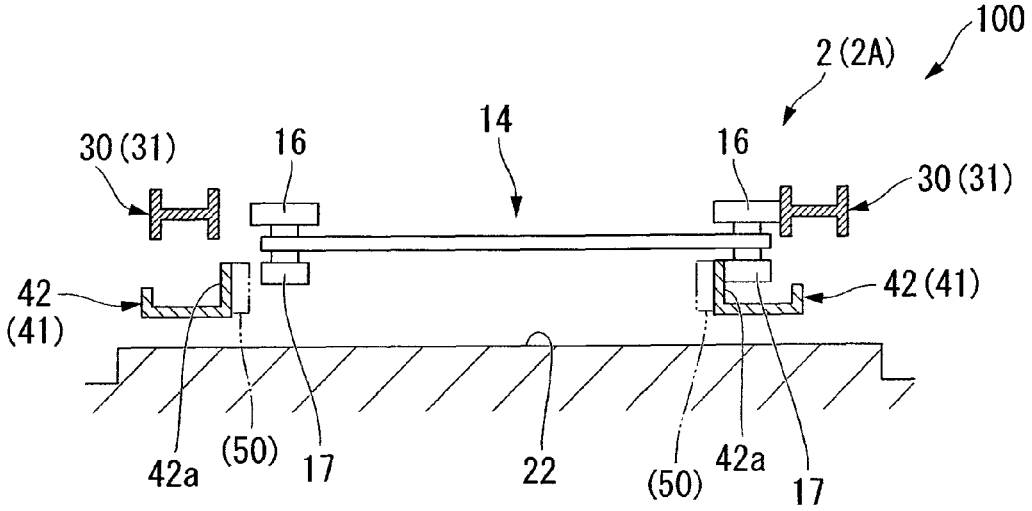
FIG. 3 is a cross-sectional view of the main part of the new transit system (APM) according to the embodiment of the present invention, which is a cross-sectional view of FIG. 2, taken along the I-I line.
Figure 4:
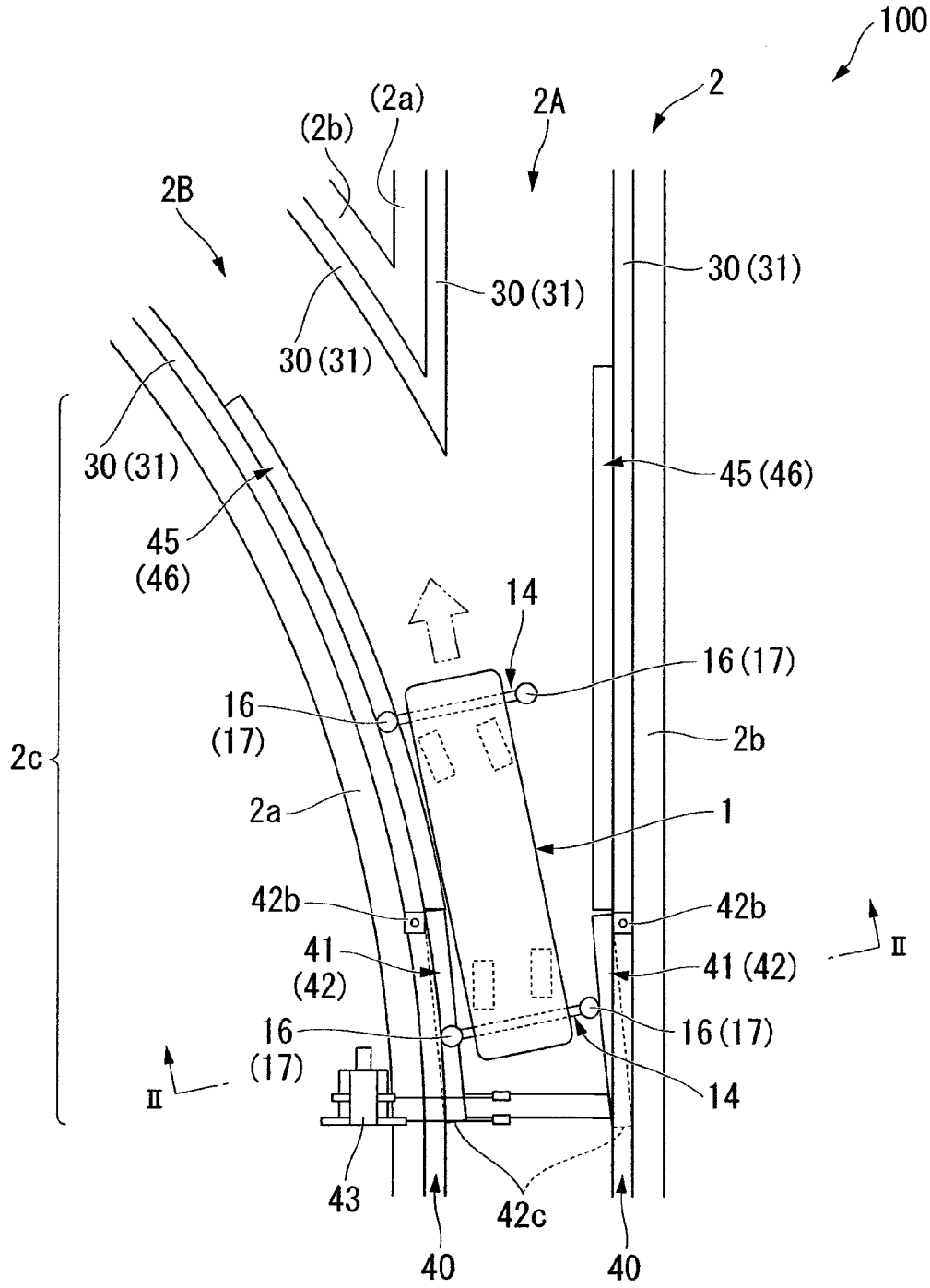
FIG. 4 is a plan view showing the schematic structure of the new transit system (APM) according to the embodiment of the present invention, which shows a state different from that of FIG. 2.
Figure 5:
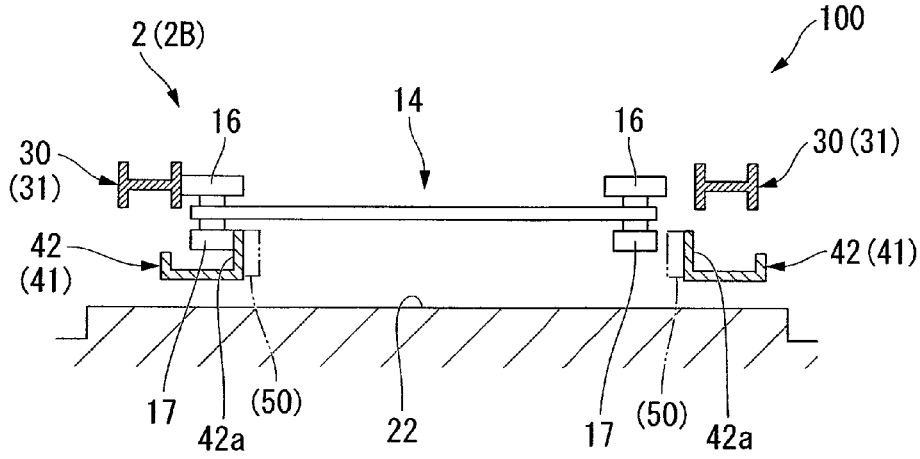
FIG. 5 is a cross-sectional view of the main part of the new transit system (APM) according to the embodiment of the present invention, which is a cross-sectional view of FIG. 4, taken along the II-II line.

FIG. 3 is a cross-sectional view of FIG. 2, taken along the I-I line. FIG. 4 is the plan view of a schematic structure of the APM 100 when the vehicle 1 proceeds to the branch track 2B. FIG. 5 is a cross-sectional view of FIG. 4, taken along the II-II line.

As shown in FIG. 3 and FIG. 5, the movable guide portion 41 includes a long, L-shaped rail 42 that is formed into a substantially L shape when seen in a cross-sectional view. The movable guide portion 41 is disposed on both sides of the track 2 in the width direction with its inside surface (guide rail surface) 42*a* facing outwardly.

As shown in FIG. 2 and FIG. 4, the L-shaped rails 42 are connected to a switching machine 43, and have a protruded piece 42*b* formed at their rear ends. The L-shaped rails 42 are rotationally moved in a synchronized manner with the protruded pieces 42*b* as their center of rotation. A forward end portion 42*c* of each L-shaped rail 42 is configured to be displaceable, when seen in a planar view, from a position at which it overlaps the H-shaped rail 31 toward the inner direction in the width direction by the same amount as the diameter of the switch wheel 17. When the forward end portion 42*c* of a first L-shaped rail 42 is located on the inner side in the width direction, the forward end portion 42*c* of a second L-shaped rail 42 is located directly below the H-shaped rail 31 (see FIG. 3 and FIG. 5), With such a structure, in the case where a first forward end portion 42*c* of the two L-shaped rails 42 is located on the inner side in the width direction, a first switch wheel 17 is guided while in contact with the inside surface 42*a* of the first L-shaped rail 42. This restricts the direction of rolling of the running wheels 12. At this time the forward end portion 42*c* of a second L-shaped rail 42 is located directly below the H-shaped rail 31, and hence does not interfere with a second switch wheel 17.

In other words, of the two switch wheels 17 of the guide wheel unit 14, only a first switch wheel 17 engages its corresponding L-shaped rail 42, and a second switch wheel 17 does not engage its corresponding L-shaped rail 42.

Figure 6:
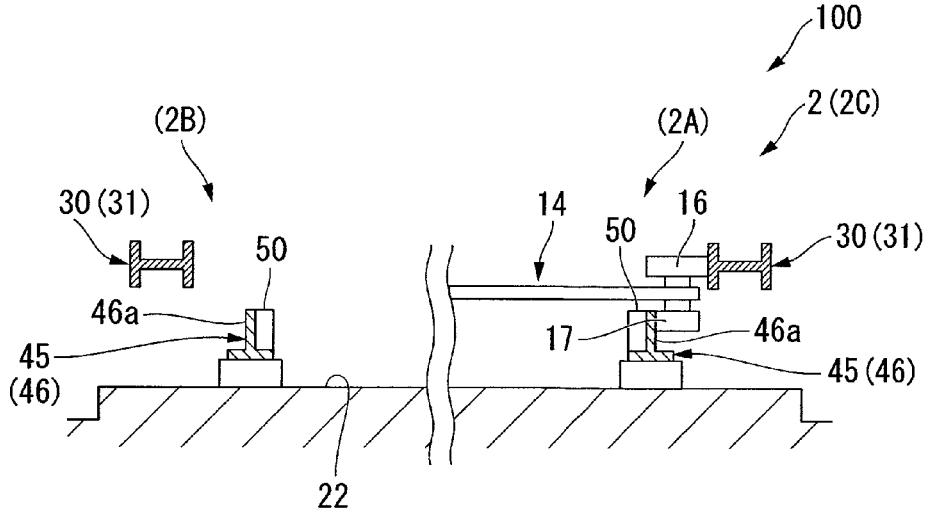
FIG. 6 is a cross-sectional view of the main part of the new transit system (APM) according to the embodiment of the present invention, which is a cross-sectional view of FIG. 2, taken along the II-III line.

FIG. 6 is a cross-sectional view of FIG. 2, taken along the line.

As shown in FIG. 6, the fixed guide portion 45 includes a long, T-shaped rail 46 that is formed into a substantially T shape when seen in a cross-sectional view. As shown in FIG. 2 and FIG. 4, the fixed guide portion 45 is disposed on the side wall portion 2*a* side of the branch track 2B and on the side wall portion 2*b* side of the main track 2A. An outside surface (guide rail surface) 46*a* of each T-shaped rail 46 is disposed so as to be continuous (to be substantially flush) with the inside surface 42*a* of the L-shaped rail 42.

With such a structure, the T-shaped rail 46 brings the switch wheel 17, which has been guided while in contact with the inside surface 42*a* of the L-shaped rail 42, into contact with the outside surface 46*a* and guides to the end of the branch portion 2C.

The switch guide rail 40 with the above structure brings the switch wheel 17 which is engaged the L-shaped rail 42 on the main track 2A side into engagement with the T-shaped rail 46 on the main track 2A side, to thereby guide the vehicle 1 into the main track 2A. Similarly, the switch guide rail 40 brings the switch wheel 17 which is engaged the L-shaped rail 42 on the branch track 2B side into engagement with the T-shaped rail 46 on the branch track 2B side, to thereby guide the vehicle 1 into the branch track 2B.

(Example in which Present Invention is Applied to Fixed Guide Portion 45 of Switch Guide Rail 40)

An example will be described in which the present invention is applied to the fixed guide portion 45 of the switch guide rail 40 in the APM 100 with the aforementioned structure.

Figure 7:
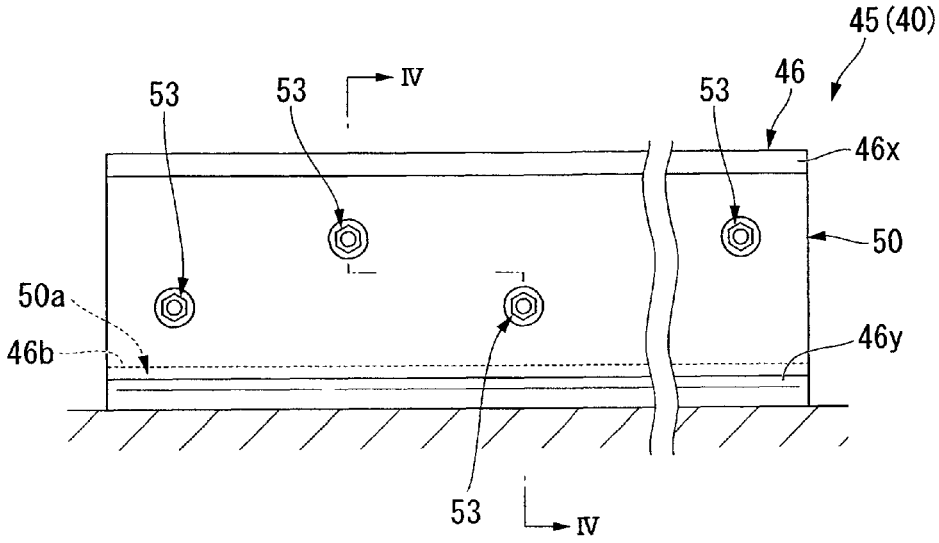
FIG. 7 is a side view of a fixed guide portion of a switch guide rail according to the embodiment of the present embodiment.
Figure 8:
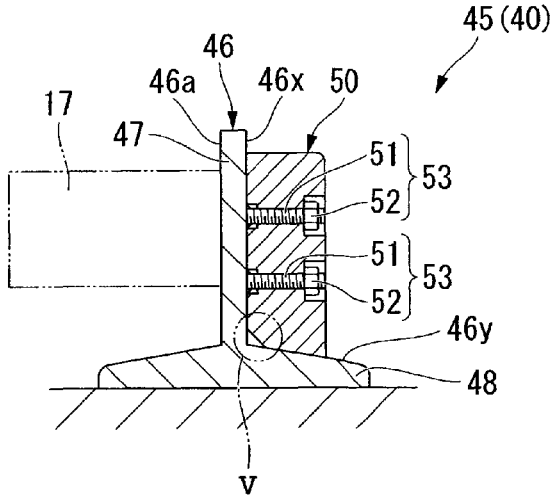
FIG. 8 is a cross-sectional view of the main part of the fixed guide portion of the switch guide rail according to the embodiment of the present invention, which is a cross-sectional view of FIG. 7, taken along the IV-IV line.
Figure 9:
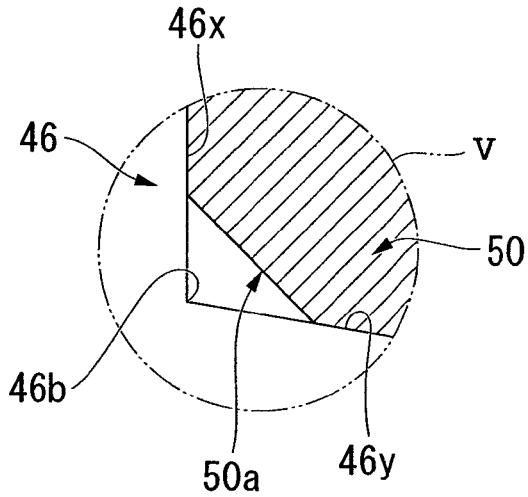
FIG. 9 is an enlarged view of the main part of the fixed guide portion of the switch guide rail according to the embodiment of the present invention, which is an enlarged view of a main part V of FIG. 8.
Figure 10:
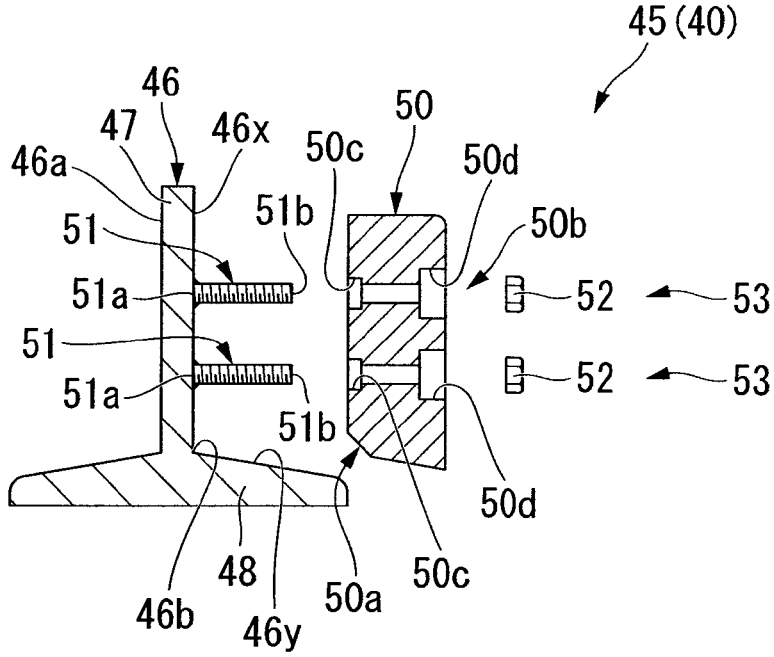
FIG. 10 is an exploded view of a component of the fixed guide portion of the switch guide rail according to the embodiment of the present invention.

FIG. 7 is a side view showing the fixed guide portion 45 of the switch guide rail 40. FIG. 8 is a cross-sectional view of FIG. 7, taken along the IV-IV line. FIG. 9 is an enlarged view of a main part V of FIG. 8. FIG. 10 is a component exploded view of the fixed guide portion 45.

As shown in FIG. 8, the fixed guide portion 45 includes: the aforementioned T-shaped rail 46; a vibration-isolating member 50; and a plurality of fixation units (fixation units) 53 each made of a bolt 51 and a nut 52. Note that the T-shaped rail 46 is formed of: a guide portion 47 with which the switch wheel 17 is brought into contact; and a support portion 48 that supports the guide portion 47.

The vibration-isolating member 50 is made from polymeric polyurethane rubber with viscosity and elasticity. It has, for example, a Young's modulus of $1.0\times10^3$ MPa or less and a loss coefficient of 0.05 or greater at normal temperature.

As shown in FIG. 10, the vibration-isolating member 50 has a substantially rectangular shape when seen in a cross-sectional view. As shown in FIG. 8, the vibration-isolating member 50 is fixed in close contact with a back surface 46*x* of the outside surface (guide rail surface) 46*a* of the guide portion 47 with which the switch wheel 17 is brought into contact, and also in close contact with a side surface 46*y* of the support portion 48.

As shown in FIG. 9 and FIG. 10, in the vibration-isolating member 50 like this, a corner portion 50*a* that faces a corner portion 46*b* formed between the back surface 46*x* of the guide portion 47 and the side surface 46*y* of the support portion 48 is chamfered. As shown in FIG. 7, the chamfered corner portion 50*a* runs in the longitudinal direction.

As shown in FIG. 8 and FIG. 10, in the vibration-isolating member 50, a plurality of through-holes 50*b* are formed that penetrate in the width direction of the vehicle 10 in a staggered arrangement in the longitudinal direction so as to be displaced in the height direction orthogonal to the longitudinal direction.

In the through-hole 50*b*, a small-diameter hole with a diameter larger than that of the through-hole 50*b* is formed at a base end 50*c* on the back surface 46*x* side, and a large-diameter hole with a diameter larger than that of the through-hole 50*b* is formed at a terminal end 50*d*.

It is desirable that, the vibration-isolating member 50 be provided so as to include the range in the vertical direction with which the switch wheel 17 is brought into contact, as shown in FIG. 8.

As shown in FIG. 8 and FIG. 10, each fixation unit 53 is made of: a bolt 51 and a nut 52.

The bolt 51 has a first end portion 51 a weld-bonded onto the back surface 46*x* as shown in FIG. 10, and runs through the through-hole 50*b* as shown in FIG. 8. As shown in FIG. 8 and FIG. 10, the nut 52 is screwed on a second end portion 51*b* side of the bolt 51.

With such a structure, the fixation units 53 tighten the nuts 52 on the bolts 51, to thereby press the vibration-isolating member 50 against the T-shaped rail 46 for fixation. To be more specific, the nuts 52 press the vibration-isolating member 50 against the back surface 46*x* to bring them into close contact with each other. In addition, with this pressing, the vibration-isolating member 50 is deformed in the vertical direction. Thereby, the vibration-isolating member 50 is brought into close contact with the side surface 46*y* of the support portion 48.

At this time, a swell-out portion that is swollen by deformation of the vibration-isolating member 50 produced in the vicinity of the first end portion 51*a* of the bolt 51 is contained in the small-diameter hole of the base end 50*c*. Therefore, the portion around the base end 50*c* of the vibration-isolating member 50 is favorably in close contact with the back surface 46*x*.

One example of an assembly method of the fixed guide portion 45 with the aforementioned structure will be described below.

First, the first end portions 51*a* of the bolts 51 are weld-bonded onto the back surface 46*x* of the guide portion 47 of the T-shaped rail 46 by stud welding. The bolts 51 are welded one after another so that the bolts 51 are in a staggered arrangement with difference in position in the longitudinal direction and also in the height direction orthogonal to the longitudinal direction. After completion of the weld-bonding of the bolts 51, the vibration-isolating member 50 is brought into close contact with the T-shaped rail 46 so that each bolt 51 runs through its corresponding through-hole 50*b*. The nuts 52 are screwed on their corresponding bolts 51 and are then tightened, to thereby bring the vibration-isolating member 50 into close contact with the T-shaped rail 46.

At this time, the fixation units 53 are provided in a staggered arrangement in the longitudinal direction so as to be displaced in the height direction orthogonal to the longitudinal direction. Therefore, the vibration-isolating member 50 is pressed evenly against the back surface 46*x* in the longitudinal direction and the height direction. Thereby, the vibration-isolating member 50 is uniformly brought into close contract with the back surface 46*x*.

Next is a description of working of the fixed guide portion 45 of the switch guide rail 40 with the above structure.

As shown in FIG. 4 and FIG. 5, when engaging the L-shaped rail 42 on the branch track 2B, the switch wheel 17 is guided by the T-shaped rail 46 on the branch track 2B into engagement with the T-shaped rail 46, thus introducing the vehicle 1 into the branch track 2B.

At this time, as shown in FIG. 8, when the outside surface (guide rail surface) 46*a* of the T-shaped rail 46 is brought into collision contact or rolling contact with the switch wheel 17, vibration generated by the contact is transmitted to the back surface 46*x*. Then, the vibration having been transmitted to the back surface 46*x* is efficiently transmitted to the vibration-isolating member 50 that is in close contact with the back surface 46*x*.

A part of the vibration generated by the above contact is transmitted to the side surface 46*y* of the support portion 48 through the inside of the T-shaped rail 46. Then, the vibration having been transmitted to the side surface 46*y* of the support portion is efficiently transmitted from the side surface 46*y* of the support portion to the vibration-isolating member 50 that is in close contact with the side surface 46*y* of the support portion.

Then, the energy of the vibration transmitted to the vibration-isolating member 50 is consumed by frictional heat resulting from the viscous movements of the molecules. That is, the vibration generated by the contact between the outside surface 46*a* and the switch wheel 17 is decreased in the vibration-isolating member 50, making the amount of vibration propagating through the air very small. Thus, the noise is suppressed.

Through the travel of the vehicle 1, the position of the outside surface 46*a* of the T-shaped rail 46 at which the switch wheel 17 rolls sequentially shifts in the longitudinal direction. However, provision of the vibration-isolating member 50 along the longitudinal direction of the T-shaped rail 46 reduces the noise at parts of the T-shaped rail 46 in the longitudinal direction. At this time, the fixation units 53 are disposed in a staggered arrangement in the longitudinal direction so as to be displaced in the height direction orthogonal to the longitudinal direction, and press the vibration-isolating member 50 uniformly against the T-shaped rail 46. Therefore, the noise is uniformly reduced over the whole area in the longitudinal direction. In other words, the vibration from the T-shaped rail 46 is reduced by its uniform transmission over the whole of the vibration-isolating member 50.

As described above, according to the switch guide rail 40, which includes the vibration-isolating member 50 provided on the back surface 46*x* of the outside surface 46*a*, it is possible to suppress noise. That is, when the switch wheel 17 is brought into collision contact or rolling contact with the outside surface 46*a*, the vibration generated by the contact is transmitted from the back surface 46*x* to the vibration-isolating member 50. Then, the energy of the vibration having been transmitted to the vibration-isolating member 50 is consumed by frictional heat of the molecules in the vibration-isolating member 50. Thereby, the vibration is reduced. Here, for the outside surface 46*a* in which the vibration is generated, the vibration-isolating member 50 is provided on the back surface 46*x* of the outside surface 46*a*, it is possible to effectively transmit the vibration generated in the outside surface 46*a* to the vibration-isolating member 50 on the back surface 46*x* and reduce the vibration. Therefore, it is possible to effectively suppress the noise made by the airborne propagation of the vibration, which is generated by the contact between the switch wheel 17 and the outside surface 46*a*, from the T-shaped rail 46. Therefore, because the vibration resulting from the contact between the outside surface 46*a* and the switch wheel 17 is reduced in the vibration-isolating member 50, it is possible to suppress the noise.

Figure 11:
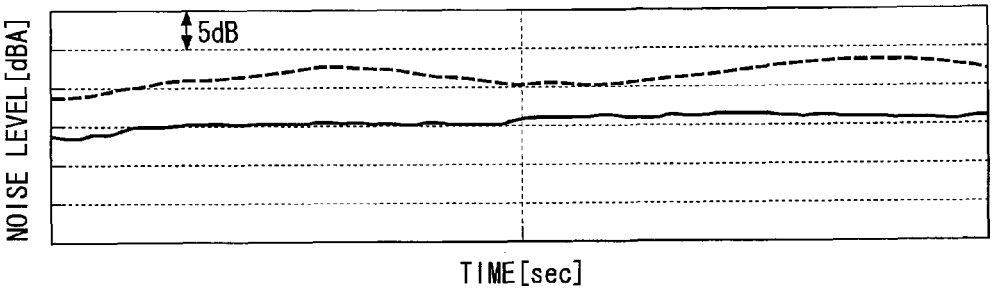
FIG. 11 is an explanation view of an effect of the fixed guide portion of the switch guide rail according to the embodiment of the present invention, which is a comparative diagram showing noise from a switch guide rail and noise from a switch guide rail made only of T-shaped rails.

FIG. 11 is a comparative diagram showing noise from the switch guide rail 40 provided with the vibration-isolating member 50 and noise from a switch guide rail made only of the T-shaped rail 46. FIG. 11 shows noise levels measured with the switch wheel 17 being rolled on the outside surface 46*a*. The axis of abscissas represents time, and the axis of ordinate represents noise level. In FIG. 11, an interior noise level during traveling (at a traveling speed of 50 km/h) for the case of the vibration-isolating member 50 provided with the switch guide rail 40 is denoted by a solid line, and an interior noise level during traveling (at a traveling speed of 50 km/h) for the case of the switch guide rail made only of the T-shaped rail 46 is denoted by a dashed line.

As shown in FIG. 11, according to the switch guide rail 40, the noise level is approximately 5 to 7 dB lower than that of the switch guide rail made only of the T-shaped rail 46. Therefore, an effect of noise suppression can be verified.

The vibration-isolating member 50 is in contact also with the side surface 46*y* of the support portion 48. Therefore, the vibration by the contact between the switch wheel 17 and the outside surface (guide rail surface) 46*a* is transmitted also to the vibration-isolating member 50 from the side surface 46*y* of the support portion 48 other than from the back surface 46*x*. With this enlarged contact area between the vibration-isolating member 50 and the T-shaped rail 46, it is possible to decrease, in the vibration-isolating member 50, the vibration transmitted from the side surface 46*y* of the support portion. This makes it possible to further suppress the noise.

The fixation units 53 fix the vibration-isolating member 50 by pressing against the T-shaped rail 46 along the direction of the normal of the back surface 46*x*. Therefore, it is possible to effectively bring the vibration-isolating member 50 into close contact with the T-shaped rail 46, and also to effectively transmit the vibration from the T-shaped rail 46 to the vibration-isolating member 50. Furthermore, it is possible to securely fix the vibration-isolating member 50 to the back surface 46*x* of the T-shaped rail 46 in a closely contacted manner, to thereby continuously obtain an effect of noise suppression.

The fixation units 53 that fix the vibration-isolating member 50 by pressing against the back surface 46*a* of the T-shaped rail 46 are provided. Therefore, it is possible to more effectively bring the vibration-isolating member 50 into close contact with the T-shaped rail 46 and to more effectively transmit the vibration from the T-shaped rail 46 to the vibration-isolating member 50. Furthermore, it is possible to securely fix the vibration-isolating member 50 to the T-shaped rail 46 in a closely contacted manner, to thereby continuously obtain an effect of noise suppression.

The vibration-isolating member 50 runs in the longitudinal direction of the T-shaped rail 46, and a plurality of fixation units 53 are provided in a staggered arrangement in the longitudinal direction and in a staggered manner in the height direction orthogonal to the longitudinal direction. As a result, it is possible to fix the vibration-isolating member 50 to the T-shaped rail 46 with a uniform force. Therefore, it is possible to transmit the vibration from the T-shaped rail 46 uniformly over the whole of the vibration-isolating member 50, to thereby reduce the vibration.

Figure 12:
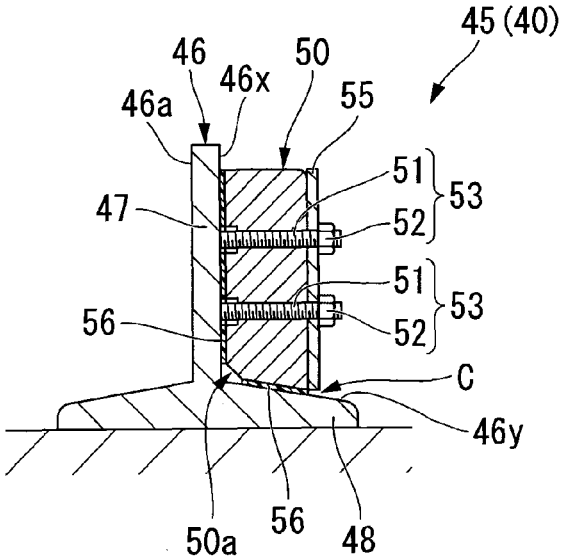
FIG. 12 is an enlarged view showing the main part of a first modification of the fixed guide portion of the switch guide rail according to the embodiment of the present invention.

In the aforementioned structure, the fixation units 53 are arranged in a staggered manner to uniformly press the vibration-isolating member 50 against the back surface 46*x*. However as shown in FIG. 12, there may, for example, be provided a plate member (plate) 55 between the nuts 52 and the vibration-isolating member 50 along the back surface 46*x*.

With such a structure, the fixation units 53 press the plate member 55 against the vibration-isolating member 50, to thereby fix the vibration-isolating member 50. Therefore, it is possible to disperse the tightening force by the fixation units 53 over all the plate surface of the plate, to thereby fix the vibration-isolating member 50 to the T-shaped rail 46 with a uniform force. In other words, the pressing region of each nut 52 against the vibration-isolating member 50, which has been point load, is made surface load through the intervention of the plate member 55. This makes it possible to bring the vibration-isolating member 50 into close contact with the back surface 46$x$ more uniformly. Therefore, without making vibration transmitted from the T-shaped rail 46 to the vibration-isolating member 50 non-uniform, it is possible to uniformly reduce the vibration in the respective parts of the vibration-isolating member 50.

With the provision of the plate member 55, vibration is reduced not only by the aforementioned frictional heat, but also by a displacement (shear strain) between the vibration-isolating member 50 and the plate member 55 that is produced by a deformation due to a vibration stress caused by both sides of the vibration-isolating member 50 being fixed in the width direction by two interfaces of the back surface 46$x$ and the plate member 55. Therefore, it is possible to reduce vibration more, to thereby further suppress noise.

At this time, a gap C may be provided between the plate member 55 and the T-shaped rail 46 to put the two in a non-contact state. As a result, it is possible to suppress vibration from being transmitted from the side surface 46$y$ of the support portion 48 to the plate member 55 (being transmitted while avoiding the vibration-isolating member 50), and hence, it is possible to suppress vibration from propagating through the air which makes noise.

As shown in FIG. 12, the vibration-isolating member 50 may be bonded to the back surface 46$x$ and the side surface 46$y$ of the support portion 48. The degree of close contact between the vibration-isolating member 50 and the back surface 46$x$ as well as the side surface 46$y$ of the support portion 48 is increased in this manner, to thereby make it possible to efficiently transmit vibration to the vibration-isolating member 50 and increase the total amount of consumed energy. At this time, the transmission efficiency of vibration increases in proportion to the hardness of the adhesion layer 56. Therefore, it is desirable that a curing-type adhesive (for example, an adhesive based on two-component epoxy) be used.

Note that, in FIG. 12, the fixation units 53 and the adhesive are used in combination to increase the degree of close contact between the back surface 46$x$ and the vibration-isolating member 50. However, only one of the two may be used. Alternatively, both may be omitted.

Figure 13:
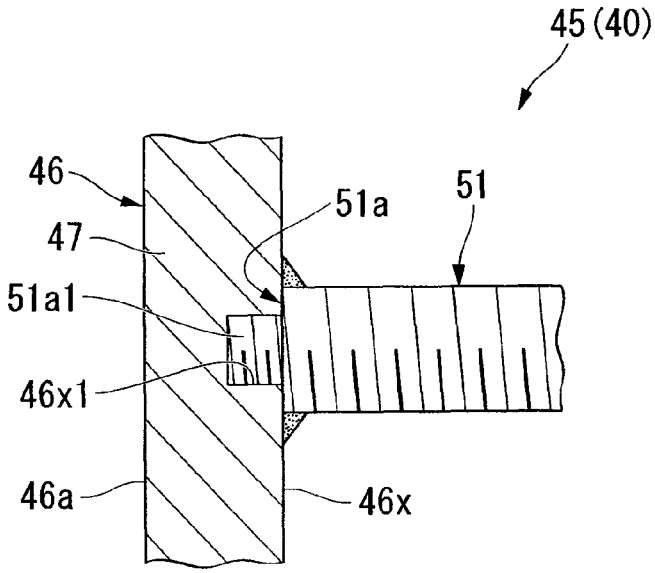
FIG. 13 is an enlarged view showing the main part of a second embodiment of the fixed guide portion of the switch guide rail according to the embodiment of the present invention.

In the aforementioned structure, stud welding is used to weld-bond the bolts 51 to the back surface 46$x$. However, another method may be used to fix them. For example, as shown in FIG. 13, there is a method as follows. The first end portion 51$a$ of the bolt 51 is formed in a small diameter and a male thread portion 51$a$1 is formed in its outer circumferential surface. On the other hand, a female thread portion 46$x$1 to be threaded onto the male thread portion 51$a$1 is provided in the back surface 46$x$. The male thread portion 51$a$1 is screwed into the female thread portion 46$x$1. The bolt 51 and the back surface 46$x$ are then welded while kept substantially perpendicular to each other.

(Example in which Present Invention is Applied to Travel Guide Rail 30)

Next, an example will be described in which the present invention is applied to the travel guide rail 30 in the APM 100 with the aforementioned structure.

Figure 14:
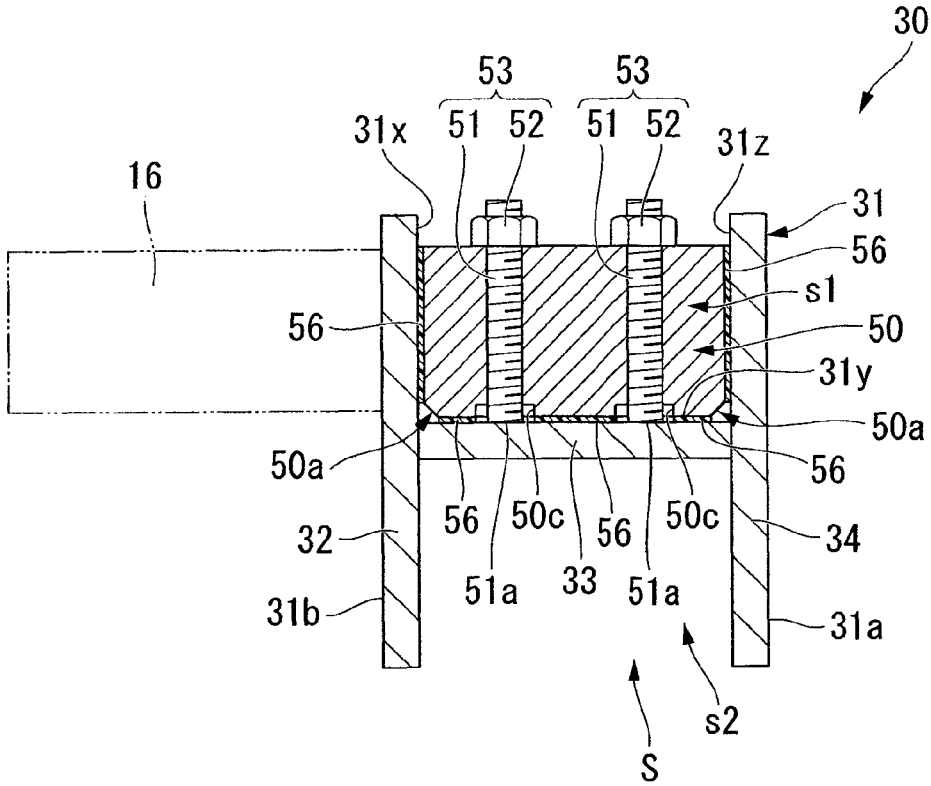
FIG. 14 is an enlarged view showing a travel guide rail according to the embodiment of the present invention.

FIG. 14 is an enlarged view of the main part of the travel guide rail 30. In FIG. 14, like constituent elements to those of FIG. 1 to FIG. 13 are designated with like reference symbols, and description thereof is omitted (the same is true of FIG. 15 and FIG. 16, which will be described later).

As shown in FIG. 14, the travel guide rail 30 includes: the aforementioned H-shaped rail 31; a vibration-isolating member 50; and a plurality of fixation units 53. The H-shaped rail 31 is formed of: a guide portion 32 with which the guide wheel 16 is brought into contact; a support portion 33 that supports the guide portion 32; and a fixed portion 34 that has a fixed surface 31$a$.

As shown in FIG. 14, the vibration-isolating member 50 is provided between the guide portion 32 and the fixed portion 34 so as to fill a space s1 on the upper side of a space S, which is vertically partitioned by the support portion 33 connecting the guide portion 32 with the fixed portion 34. That is, the vibration-isolating member 50 is fixed, in a closely contacted manner, to a back surface 31$x$ of a guide rail surface 31$b$ of the guide portion 32, a side surface 31$y$ of the support portion 33, and an opposite surface 31$z$ of the fixed portion 34 that is opposed to the back surface 31$x$ of the guide portion 32.

Here, the fixation units 53 are provided so as to be in close contact with the side surface 31$y$ of the support portion 33. The vibration-isolating member 50 is compressed and deformed between the nuts 52 and the side surface 31$y$ of the support portion 33, to thereby swell out in the normal of the back surface 31$x$. This brings the vibration-isolating member 50 into close contact with the back surface 31$x$ and the opposite surface 31$z$.

According to the travel guide rail 30, on the principle similar to that for the aforementioned fixed guide portion 45 of the switch guide rail 40, it is possible to effectively reduce vibration when the guide wheel 16 is brought into contact with the upper portion of the guide rail surface 31$b$, to thereby suppress noise. Therefore, it is possible to obtain the aforementioned effects.

The vibration generated by contact between the inner surface 31$b$ and the guide wheel 16 is transmitted to the vibration-isolating member 50 not only from the back surface 31$x$ and the side surface 31$y$ of the support portion 33 but also from the opposite surface 31$z$.

In the structure of FIG. 14, the vibration-isolating member 50 is fixed to the H-shaped rail 31 in a closely contacted manner by use of the fixation units 53 and the adhesive (adhesion layer 56). However, as shown in FIG. 15, a vibration-isolating member in a fluid state may be filled in the space s1 and then vulcanized to be bonded to the H-shaped rail 31.

Figure 15:
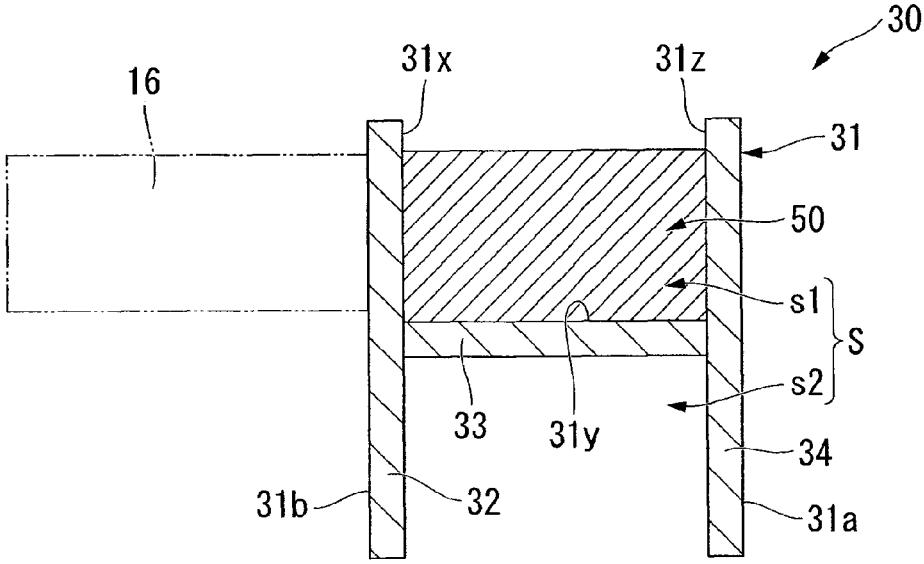
FIG. 15 is an enlarged view showing the main part of a first modification of the travel guide rail according to the embodiment of the present invention.
Figure 16:
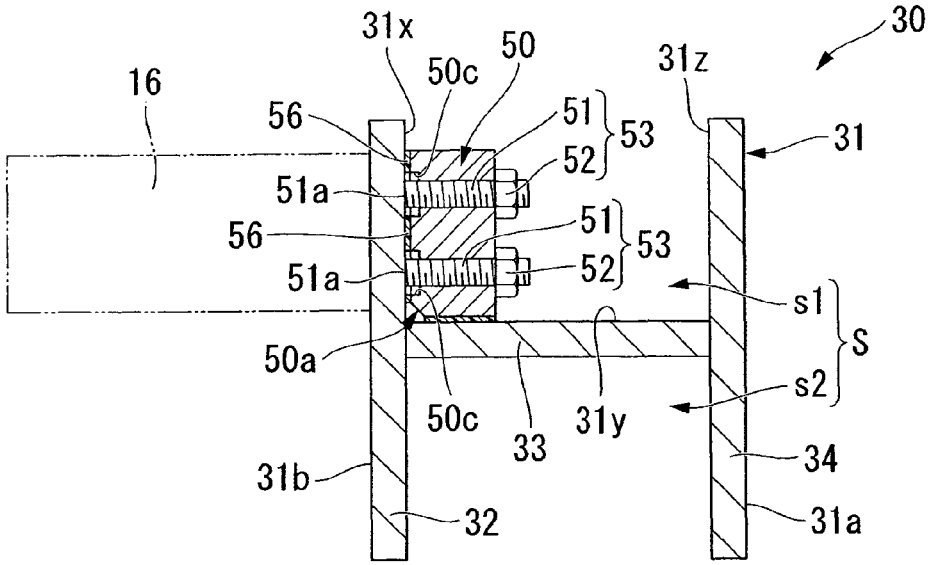
FIG. 16 is an enlarged view showing the main part of a second modification of the travel guide rail according to the embodiment of the present invention.

In the structures shown in FIG. 14 and FIG. 15, the vibration-isolating member 50 is configured to be positioned over substantially the entire space sl. However, as shown in FIG. 16, the vibration-isolating member 50 may be positioned partially on the back surface 31$x$ side of the guide portion 32 in the space s1. In this structure, the fixation units 53 may be used to increase the degree of close contact between the vibration-isolating member 50 and the back surface 31$x$. Alternatively, an adhesive (adhesion layer 56) may be used to increase the degree of close contact between the vibration-isolating member 50 and the back surface 31$x$.

In FIG. 13 to FIG. 15, the vibration-isolating member 50 may be provided in a space s2 on the lower side.

(Example in which Present Invention is Applied to Movable Guide Portion 41 of Switch Guide Rail 40)

An example will be described in which the present invention is applied to the movable guide portion 41 of the switch guide rail 40 in the APM 100 with the aforementioned structure.

Figure 17:
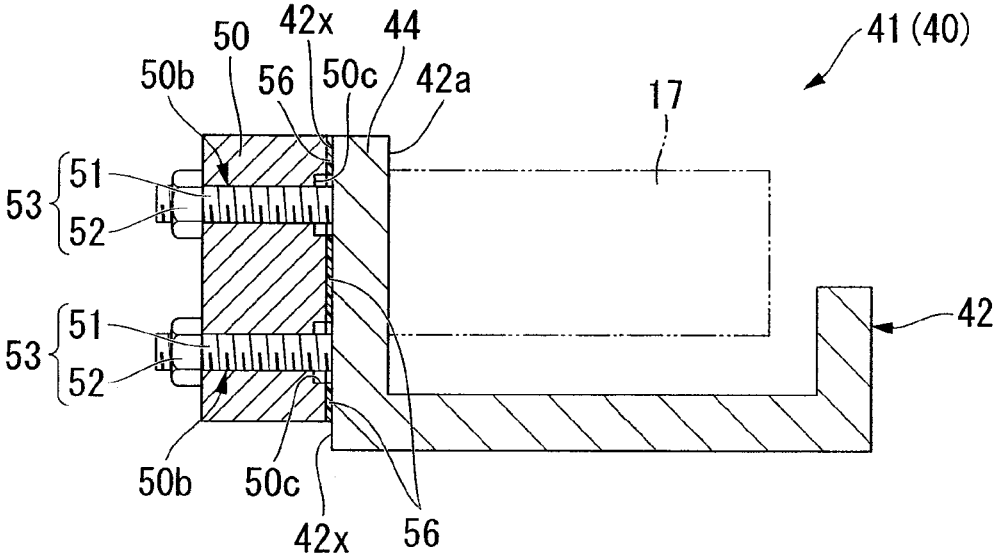
FIG. 17 is an enlarged view showing the main part of a movable guide portion of the switch guide rail according to the embodiment of the present invention.

FIG. 17 is an enlarged view of the main part of a movable guide portion 41 of a switch guide rail 40. In FIG. 17, like constituent elements to those of FIG. 1 to FIG. 16 are designated with like reference symbols, and description thereof is omitted.

As shown in FIG. 17, the movable guide portion 41 of the switch guide rail 40 includes: the aforementioned L-shaped rail 42; a vibration-isolating member 50; and a plurality of fixation units 53.

As shown in FIG. 17, the vibration-isolating member 50 is fixed, in a closely contacted manner, to a back surface 42*x* of an inside surface 42*a* of a guide portion 44 with which the switch wheel 17 is brought into contact.

According to the movable guide portion 41 of the switch guide rail 40, based on the principle similar to that for the aforementioned fixed guide portion 45, it is possible to effectively reduce vibration when the switch wheel 17 is brought into contact with the inside surface 42*a*, to thereby suppress noise. Therefore, it is possible to obtain the aforementioned effects.

The operational procedure, and shapes, combination, and the like of the constituent members illustrated in the aforementioned embodiment are merely examples, and various modifications based on design requirements and the like can be made without departing from the spirit or scope of the invention.

For example, in the aforementioned embodiment, polyurethane rubber, which is a viscoelastic body, is used as the vibration-isolating member 50. However, another material may be used as long as it is a viscoelastic material (a material that has two properties of: "viscosity" expressing fluidity of fluid matter; and "elasticity" expressing an ability of solid matter to restore to its original state. The material may be, for example, natural rubber, synthetic rubber, silicone rubber, asphalt, plastic, or the like.).

Furthermore, in the aforementioned embodiment, the new transit system in which a vehicle with rubber tires is incorporated into a rail-track-system traffic is referred to as APM. However, there are cases where this type of new transit system is referred to as ATS (Automated Transit Systems) or AGT (Automated Guide-way Transit).

In the aforementioned embodiment, the present invention is applied to the switch guide rail 40 in the branch portion 2C. However, the present invention is applicable also to a guide rail (joining guide rail) with which the tracks 2 are joined in the traveling direction of the vehicle 1.

The aforementioned embodiment has a structure in which the H-shaped rail 31 is used for the travel guide rail 30, the L-shaped rail 42 is used for the movable guide portion 41 of the switch guide rail 40, and the T-shaped rail 46 is used for the fixed guide portion 45. However, the three rails are interchangeable. For example, it is possible to use the L-shaped rail 42 or the T-shaped rail 46 for the travel guide rail 30.

INDUSTRIAL APPLICABILITY

According to the guide rail of the present invention, it is possible to suppress noise in a new transit system.

The invention claimed is:

1. A guide rail that is provided in a track and is brought into contact with a guide wheel of a vehicle to restrict a rolling direction of a running wheel of the vehicle, to thereby guide the vehicle along the track, comprising:

a rail that includes a guide portion formed with a guide rail surface with which the guide wheel is brought into contact and formed with a back surface on an opposite side thereof;

a vibration-isolating member that is provided so as to be in contact with the back surface of the guide portion; and a fixation unit that fixes the vibration-isolating member by pressing against the back surface, wherein the fixation unit comprises a bolt and a nut, wherein the bolt is fixed to the back surface and runs through the vibration-isolating member in a direction normal to the back surface, wherein the nut is screwed on the bolt so as to tighten the vibration-isolating member onto the back surface, wherein a through-hole through which the bolt is inserted penetrates the vibration-isolating member, and wherein a small-diameter hole with a diameter larger than that of the through-hole is formed at a base on a back surface side of the through-hole end facing the back surface of the guide portion, wherein the small-diameter hole accommodates a swell-out portion by deformation of the vibration isolating member.

2. The guide rail according to claim 1, wherein the rail further comprises a support portion that supports the guide portion, and wherein the vibration-isolating member is provided so as to be in contact with a side surface of the support portion.

3. The guide rail according to claim 2, wherein an angle portion of the vibration-isolating member that faces an intersection portion between the back surface and the side surface is chamfered.

4. The guide rail according to claim 2, wherein the vibration-isolating member includes a chamfered surface, and the chamfered surface is spaced apart from an intersection portion between the back surface and the side surface to form a space therebetween so that the space is defined by the chamfered surface, the back surface and the side surface.

5. The guide rail according to claim 1, further comprising a plate that is provided so as to sandwich the vibration-isolating member between the guide portion of the rail and the plate, wherein the nut presses the vibration-isolating member against the rail via the plate.

6. The guide rail according to claim 1, wherein the vibration-isolating member is provided so as to run along a longitudinal direction of the rail, and wherein a plurality of the fixation units are disposed in a staggered arrangement so as to be displaced in a direction orthogonal to the longitudinal direction.

7. The guide rail according to claim 1, wherein an adhesion layer made from an adhesive material is formed between the vibration-isolating member and the rail.

8. A new transit system comprising the guide rail according to claim 1.

9. The guide rail according to claim 1, wherein the vibration-isolating member has said swell-out portion entering in the small-diameter hole when the vibration-isolating member is pressed and deformed by the fixation unit.

10. The guide rail according to claim 9, wherein the vibration-isolating member has a large-diameter hole with a diameter larger than that of the small-diameter hole formed at a terminal end opposite to the base end of the through-hole.

11. A guide rail that is provided in a track and is brought into contact with a guide wheel of a vehicle to restrict a rolling direction of a running wheel of the vehicle, to thereby guide the vehicle along the track, comprising:

a rail that comprises a guide portion formed with a guide rail surface with which the guide wheel is brought into contact and formed with a back surface on an opposite side thereof, and a support portion for supporting the guide portion;

a vibration-isolating member that is provided so as to be in contact with the back surface of the guide portion and with a side surface of the support portion; and a fixation unit that fixes the vibration-isolating member by pressing against the side surface, wherein the fixation unit comprises a bolt and a nut, wherein the bolt is fixed to the side surface and runs through the vibration-isolating member in a direction normal to the side surface, wherein the nut is screwed on the bolt so as to tighten the vibration-isolating member onto the side surface, wherein a through-hole through which the bolt is inserted penetrates the vibration-isolating member, and wherein a small-diameter hole with a diameter larger than that of the through-hole is formed at a base on a back surface side of the through-hole end facing the back surface of the guide portion, wherein the small-diameter hole accommodates a swell-out portion by deformation of the vibration isolating member.

12. The guide rail according to claim 11, wherein the vibration-isolating member has said swell-out portion entering in the small-diameter hole when the vibration-isolating member is pressed and deformed by the fixation unit.

* * * * *